US005761764A

United States Patent [19]

Fiegel et al.

[11] Patent Number: 5,761,764

[45] Date of Patent: Jun. 9, 1998

[54] CARPET CLEANING MACHINE WITH IMPROVED SYSTEM FOR REMOVING DIRTY MATERIAL

[75] Inventors: Paul E. Fiegel, Racine; David G. Jansson; Mark A. Pleshek, both of Milwaukee, all of Wis.

[73] Assignee: Racine Industries, Inc., Racine, Wis.

[21] Appl. No.: 731,524

[22] Filed: Oct. 15, 1996

[51] Int. Cl.[6] ..... A47L 9/16

[52] U.S. Cl. ..... 15/353; 55/337; 55/DIG. 3

[58] Field of Search ..... 15/353; 55/337, 55/DIG. 3

[56] References Cited

U.S. PATENT DOCUMENTS

| | | |
|---|---|---|
| 1,211,948 | 1/1917 | Koster et al. . |
| 1,268,963 | 6/1918 | Gray . |
| 1,483,976 | 2/1924 | Hoover . |
| 1,596,041 | 8/1926 | Young . |
| 1,644,859 | 10/1927 | Strader . |
| 1,759,881 | 5/1930 | Bentley . |
| 1,891,504 | 12/1932 | Smellie . |
| 2,003,215 | 5/1935 | Nadig . |
| 2,266,075 | 12/1941 | Replogle . |
| 2,680,260 | 6/1954 | Danielsson et al. . |
| 2,824,335 | 2/1958 | Moffat . |
| 2,960,714 | 11/1960 | Senne . |
| 3,226,758 | 1/1966 | Brown et al. . |
| 3,401,420 | 9/1968 | Lofgren . |
| 3,540,072 | 11/1970 | Wolter et al. . |
| 3,624,668 | 11/1971 | Krause . |
| 3,753,268 | 8/1973 | Bayless . |
| 3,840,935 | 10/1974 | Fitzgerald, Jr. et al. . |
| 3,887,344 | 6/1975 | Smith . |
| 4,000,538 | 1/1977 | Tissier . |
| 4,097,953 | 7/1978 | Mckinney et al. . |
| 4,305,176 | 12/1981 | Lessig, III et al. . |
| 4,426,751 | 1/1984 | Nordeen . |
| 4,654,927 | 4/1987 | Novinger . |
| 4,845,794 | 7/1989 | Korski et al. . |
| 5,307,538 | 5/1994 | Rench et al. . |

*Primary Examiner*—Diana Biefeld
*Attorney, Agent, or Firm*—Jansson, Shupe, Bridge & Munger, Ltd.

[57] ABSTRACT

A carpet cleaning machine includes a centrifugal separator with an air stream exit mouth having a mouth area. The improvement involves two air flow guides having, respectively, first and second apertures. The area of the second aperture is less than that of the first aperture and the guides define an annular cavity between them. Such cavity "captures" dirty material that would otherwise pass downstream into a mechanical filter and prematurely clog such filter. A new, related machine nozzle and method for removing dirty material from air flowing in a carpet cleaning machine are also disclosed.

17 Claims, 10 Drawing Sheets

FIG. 8
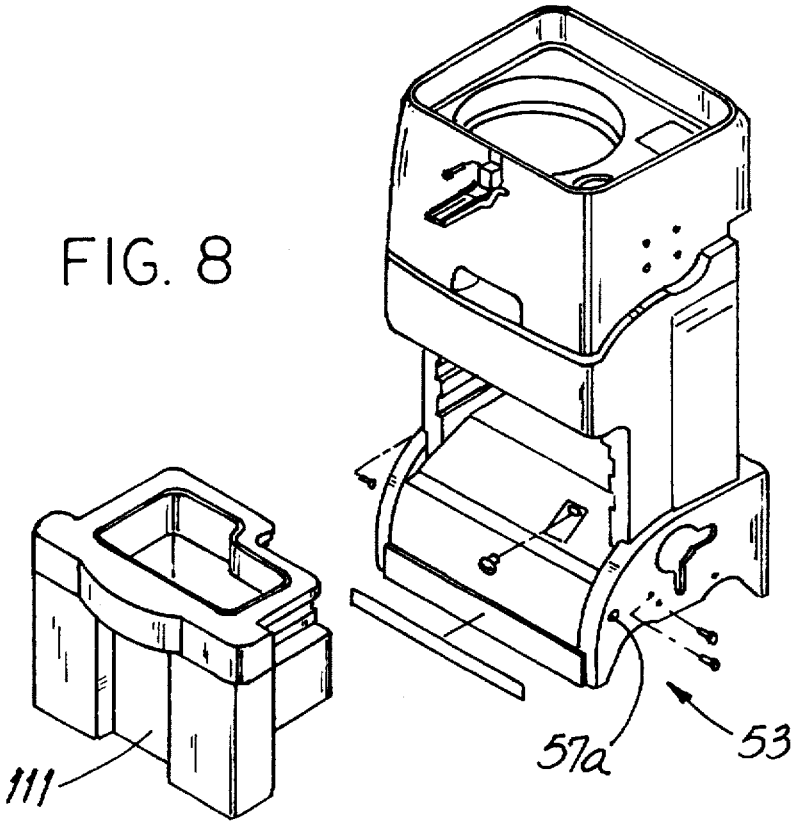
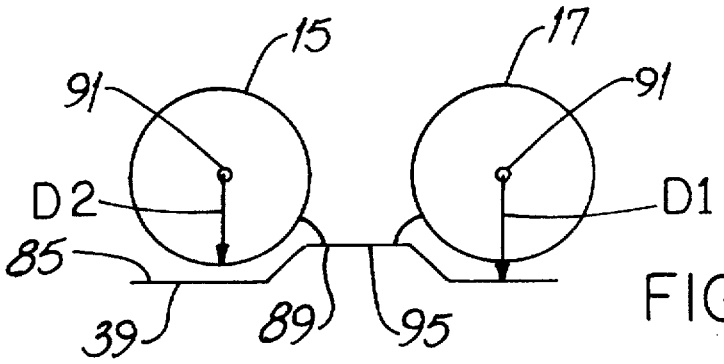
FIG. 9
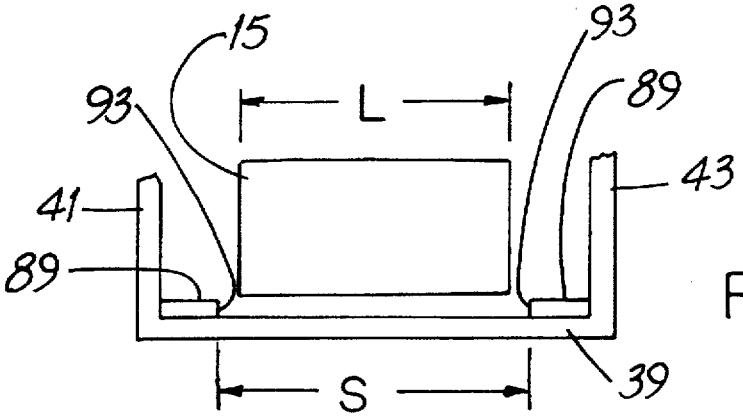
FIG. 10

CARPET CLEANING MACHINE WITH IMPROVED SYSTEM FOR REMOVING DIRTY MATERIAL

FIELD OF THE INVENTION

This invention relates generally to brushing and cleaning and, more particularly, to carpet cleaning machines with air vacuum and in situ dirt separators.

BACKGROUND OF THE INVENTION

In carpet cleaning machines, systems are well known for removing dirty material, i.e., any material such as liquid, dust, dirt-entraining particulate matter and the like which is foreign to carpet. Some systems use fine-mesh filters and others use what is often referred to as a cyclone separator or centrifugal separator. The floor cleaner disclosed in U.S. Pat. No. 2,824,335 (Moffat) is an example of the latter type.

Still others, exemplified by the machine disclosed in U.S. Pat. No. 5,307,538 (Rench et al.), use plural media of disparate types. The Rench et al. patent discloses a carpet cleaning machine-using a cyclone separator as the first of two or more "stages" for removing dirty material from a moving air stream having such dirty material entrained therein. Such a separator removes material by centrifugal force and such material drops to a collecting bin below. The machine disclosed in U.S. Pat. No. 3,320,727 (Farley et al.) also uses plural media of disparate types.

A cyclone separator rarely, if ever, removes all of the dirty material entrained in the air stream flowing through it. Some portion of such material entering the separator also leaves the separator to be filtered out of the air stream by one or more media, e.g., a mesh filter, downstream of the separator.

The fact that some dirty material passes through the separator is manifested by eventual clogging of filter(s) downstream of the separator. Of course, a filter is expected to become partially clogged over time if it is doing its job of removing dirty material from the air stream. But if clogging occurs too quickly, the machine has to be taken out of service more frequently for filter cleaning or replacement and productivity suffers.

Another aspect of carpet cleaning machines like that disclosed in the Rench et al. patent involves the matter of inspection. To view the inside of the cyclone separator, one must resort to a degree of time-consuming machine disassembly. This, too, deprives the user of some productive time, however modest.

A machine having improved dirt-removal features which help reduce machine downtime and increase productivity would be an important advance in the art.

OBJECTS OF THE INVENTION

It is an object of the invention to provide a carpet cleaning machine having dirt-removal features overcoming some of the problems and shortcomings of the prior art.

Another object of the invention to provide a carpet cleaning machine which helps prevent inordinately-rapid clogging of a filter.

Another object of the invention to provide a carpet cleaning machine, components of which are easily and quickly inspected. How these and other objects are accomplished will become apparent from the following descriptions and from the drawings.

SUMMARY OF THE INVENTION

The invention involves a carpet cleaning machine of the type including a centrifugal separator with an air stream exit mouth having a mouth area. In the improvement, a first air flow guide is fixed with respect to the mouth and includes a first "flow-through" aperture having a first area. A second air flow guide is fixed with respect to the first guide and includes a second flow-through aperture having a second area less than the first area. Thus, for air entraining dirty material to leave the separator, such air must pass through two apertures having progressively-smaller areas.

The two flow guides are configured to define a slot-like cavity between them. Such cavity captures dirty material which is removed from a carpet and passes through the first aperture, thereby preventing such material from entering and passing through the second aperture.

The arrangement is quite effective with particulate material such as HOST® dry extraction carpet cleaning granules as made by Racine Industries, Inc. of Racine, Wis., in that such material tends to "pack" in the cavity. And of course, dirty material caught in the cavity does not go downstream to clog a mesh filter. "Between-cleaning" filter life is significantly extended. And in a highly preferred embodiment, the flow guides are made of a transparent material. The machine user may view the interior of the separator (and whether or not it is clogged in some way) without removing the guides.

In another aspect of the invention, the air stream moves through the first guide in what is referred to in this specification as a first direction, i.e., away from the cone-shaped portion of the cyclone separator; that is, toward an exit opening. The cavity converges in the same direction.

Another aspect of the invention involves positional relationships of parts. The separator includes the above-noted cone-shaped portion and a generally-cylindrical neck portion above such portion and terminated by the mouth. The first guide includes a first guide portion extending into the neck portion. And the second guide includes a second guide portion extending into the neck portion.

In yet another aspect of the invention, the separator and the guides are coincident with an axis, i.e., a central axis with which the separator and guides are coincident. (In a very specific embodiment, the separator and apertures are circular and concentric with such axis.) Air flows through the separator and the guides in a first direction and the first guide includes a first transition portion tapered inwardly toward the axis in a second direction, i.e., toward the cone-shaped portion of the separator.

The second guide includes a second transition portion which also tapers inwardly toward the axis in a second direction. And while it is feasible to mount a mesh-type filter away from the guides, in a highly preferred embodiment, there is a pocket fixed with respect to the guides and, most preferably, formed in the second guide. A lift-out filter is conveniently placed in the pocket.

Still another aspect of the invention is more specific as to machine type and involves a machine having counter-revolving, cylinder-shaped first and second carpet cleaning members for removing dirty material from a carpet, and a vacuum nozzle between the cleaning members for directing the dirty material to the separator. In end view (viewed along the axes of rotation of the cleaning members), the nozzle is somewhat wedge-shaped and includes a first surface toward the first cleaning member and a second surface toward the second cleaning member.

Preferably, the surfaces of the nozzle are curved, i.e., they have a radius of curvature or radii of curvature. Most preferably, the radius of curvature of each of the first and second surfaces is greater than the radius of curvature of either the first member or the second member so that when viewed from nozzle top toward nozzle bottom, a surface of the nozzle becomes progressively farther spaced from its respective cleaning member. Most preferably, the surfaces terminate in a lower, flared mouth for drawing and entrained dirty material into the machine.

Still another aspect of the invention involves a new method for removing dirty material from air flowing through a centrifugal separator toward a filter in downstream series with the separator. The method includes the steps of providing first and second flow guides fixed with respect to the separator and having a cavity between them and flowing air-entrained dirty material into the separator. A portion of the dirty material is captured in the cavity and such material is later released to fall through the separator. The flowing step includes energizing a vacuum motor and the releasing step includes de-energizing such motor.

Other details of the invention are set forth in the following detailed description and in the drawings.

BRIEF DESCRIPTION OF THE DRAWINGS

FIG. 8 is a perspective view, partially exploded, showing housing and collection receptacle components of the machine.

FIG. 9 is a representative side elevation view showing features of the transport platform.

FIG. 10 is a representative front elevation view showing features of the transport platform.

DETAILED DESCRIPTION OF PREFERRED EMBODIMENTS

Figure 1:
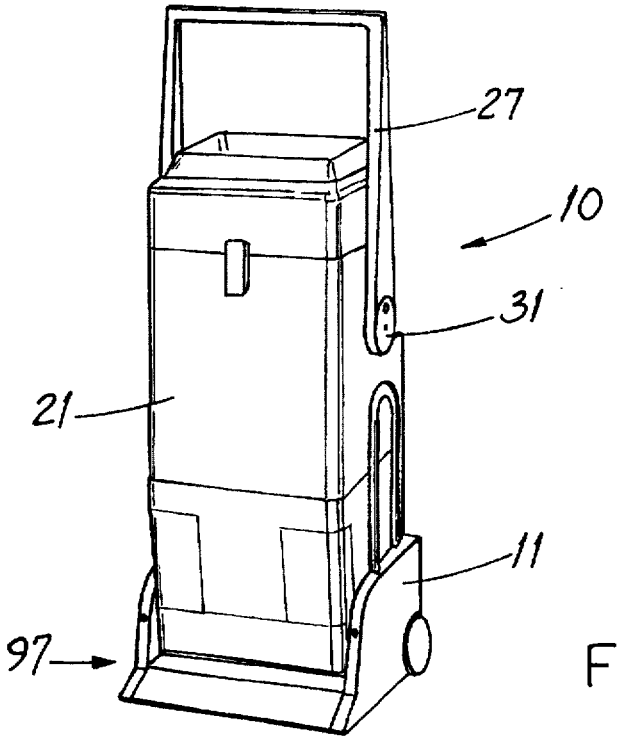
FIG. 1 is a perspective view of the carpet cleaning machine mounted in a transport platform.

The first part of this detailed description provides an overview explanation of the general arrangement of a new carpet cleaning machine 10 which "builds on" and represents a dramatic improvement over the machines shown in U.S. Pat. Nos. 2,842,788 (Rench et al.) and 2,961,673 (Rench et al.) noted above. As will become apparent, the new machine 10 has great utility as a vacuum machine for removing dirty material from carpet and also as a carpet "scrubbing" machine for cleaning carpet fibers. This is followed by a detailed explanation of a new transport platform 11 which is particularly useful in moving the machine 10 from place to place.

Next, the detailed description explains new features of the machine 10 which improve the way the machine removes dirty material from the air stream passing through it. Finally, the description sets out details of machine features which help reduce maintenance time, i.e., increase machine "uptime" or time available for productive work.

Overview

Referring first to FIGS. 1, 2, 3, 4 and 5 the new machine 10 has a lower shroud 13 covering a pair of motor-driven, cylinder-shaped, counter-revolving carpet cleaning members 15, 17. The members 15, 17 rotate in the directions represented by the arrows 19 in FIG. 5 and when the machine 10 is in use, such members 15, 17 entirely support the weight of the machine 10. (In FIG. 3, member 15 is embodied as a brush. The invention also contemplates members 15, 17 embodied as pads, rollers or the like.)

Above and rigidly coupled to the shroud 13 is a housing 21 which contains a vacuum motor 23 separately-controlled from the electric motor 35 driving the members 15, 17. The housing 21 also confines a system 25 for removing dirty material extracted from carpet 26 being cleaned and entrained in the air stream passing through the machine 10.

Figure 2:
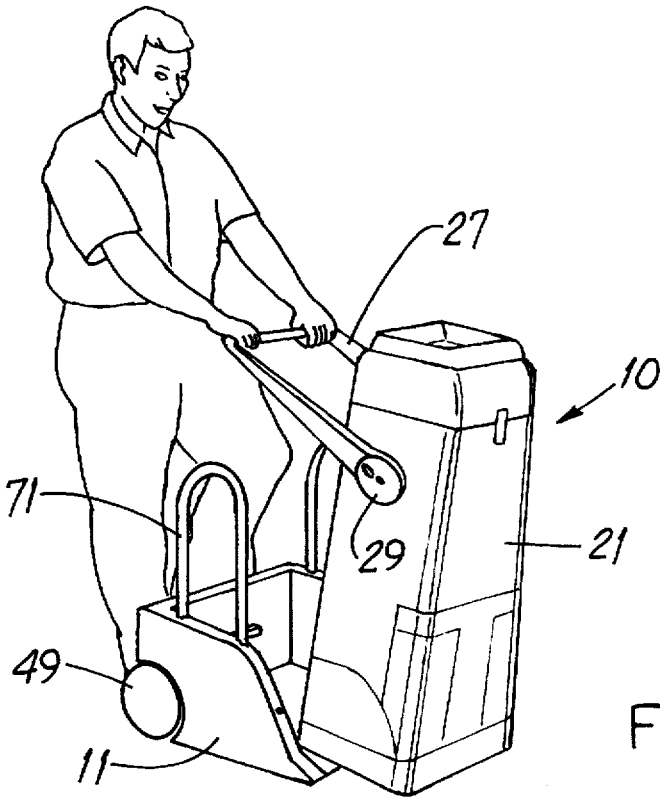
FIG. 2 is a perspective view representing how the machine is "driven" onto the platform shown in FIG. 1.

Considering FIGS. 1 and 2, an arched or "bail-type" handle 27 is pivotably coupled to the housing 21 at first and second pivot mounts 29 and 31, respectively. The handle 27 can be secured in any of several positions for cleaning carpet or moving the machine 10 and has other "free" positions described below.

Figure 3:
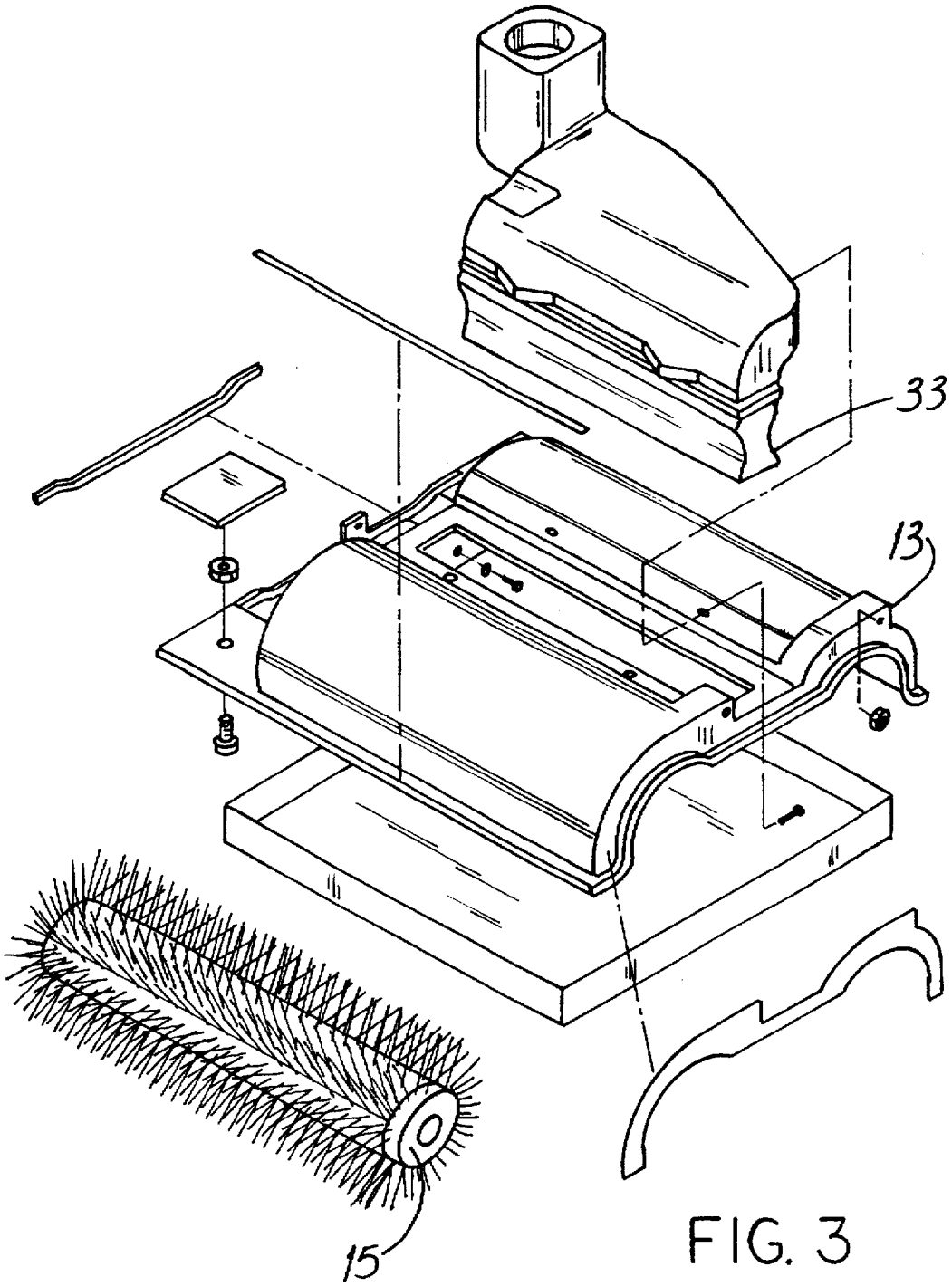
FIG. 3 is an exploded view of components of the machine.
Figure 5:
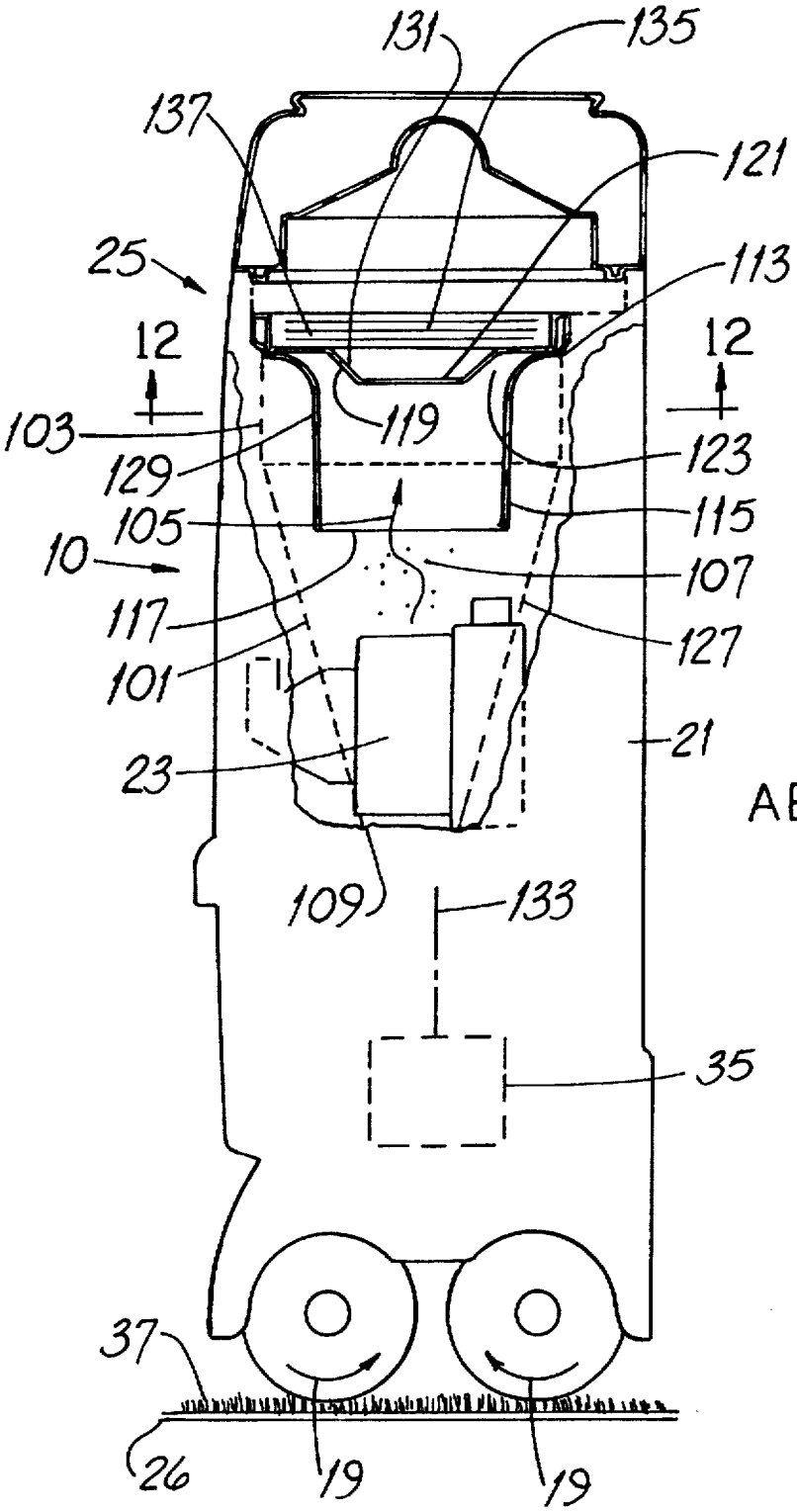
FIG. 5 is a side elevation view of the machine with parts broken away to show the air cleaning system.
Figure 12:
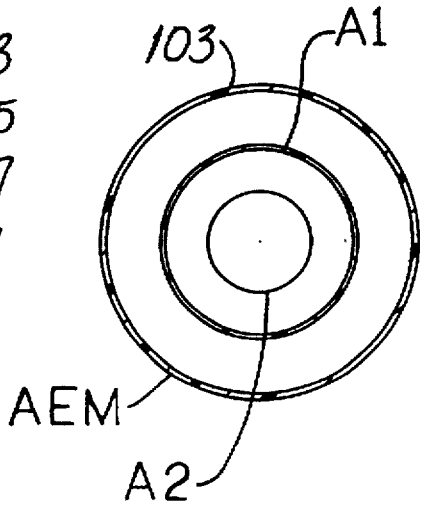
FIG. 12 is a view taken along the viewing plane 12—12 of FIG. 5.
Figure 6:
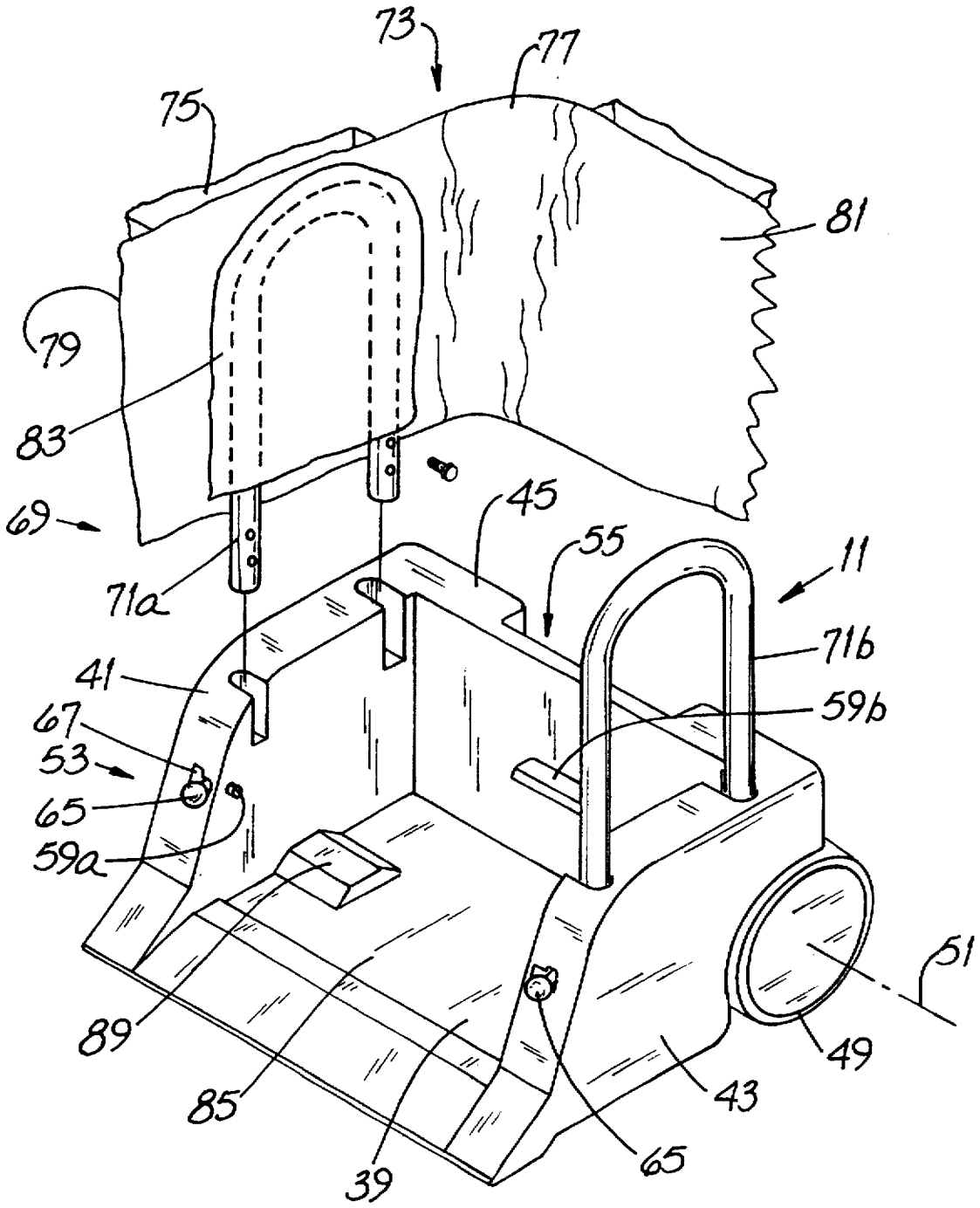
FIG. 6 is a perspective view, partially exploded, of the machine transport platform.
Figure 13:
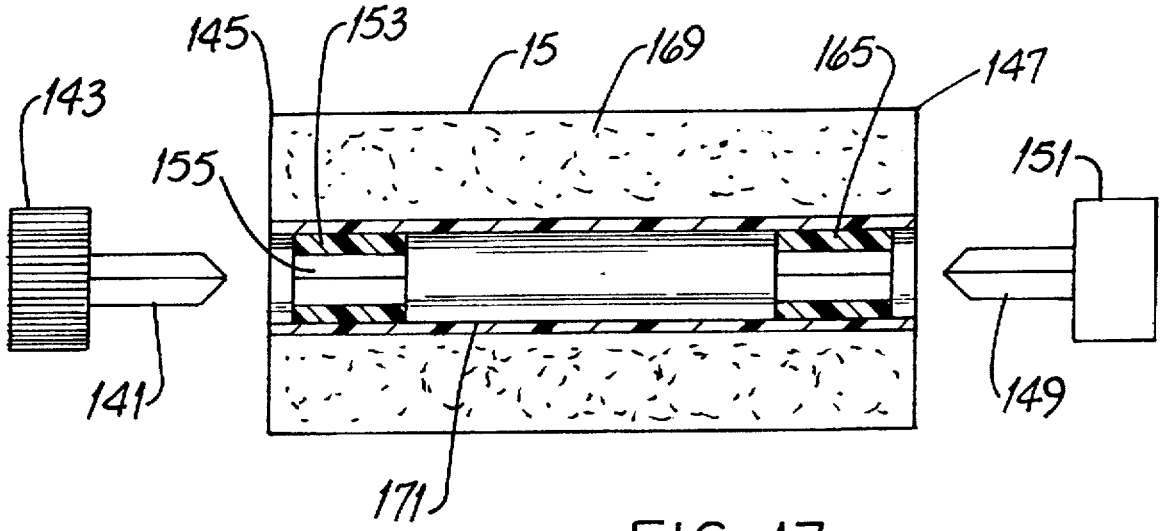
FIG. 13 is a cross-sectional view of a carpet cleaning member shown with drive and idler shafts in full representation.
Figure 14:
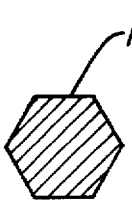
FIG. 14 is a sectional view of a hexagon torque-transmitting shape.
Figure 15:
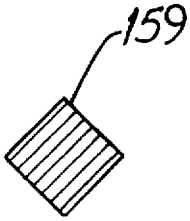
FIG. 15 is a sectional view of a square torque-transmitting shape.
Figure 16:
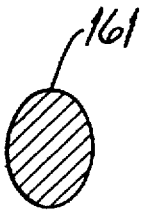
FIG. 16 is a sectional view of an oval torque-transmitting shape.
Figure 17:
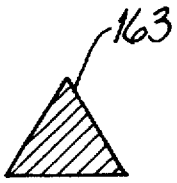
FIG. 17 is a sectional view of a triangular torque-transmitting shape.

The machine 10 may be used in either or both of two ways. As shown in FIGS. 3, 5 and 6, a vacuum nozzle 33 is between the members 15, 17 and picks up dirty material from carpet 26 when both the vacuum motor 23 and cleaning-member drive motor 35 are energized. With the vacuum motor 23 de-energized and only the cleaning-member drive motor 35 energized, the machine 10 may be used to stroke a cleaning substance along and across carpet fibers 37.

The Transport Platform

Details of the new transport platform 11 will now be set forth. Referring to FIGS. 1, 2, 3, 4 and 6–11, the new transport platform 11 includes a base 39 for supporting the machine 10, a pair of side panels 41, 43, and a rear panel 45. The panels 41, 43, 45 are attached to and extend upwardly from the base 39 to form a contiguous structure which partially encloses the shroud 13 and the bottom portion of the housing 21. So configured, the platform 11 permits the machine 10 to "nest" therein for transport.

An axle 47 is below the rear panel 45 and supports separate wheels 49 adjacent to respective side panels 41, 43. While a highly preferred embodiment includes two wheels 49 on the same axis of rotation 51, the invention contemplates that a single, elongate roller-type wheel may also be used although less conveniently—a single roller does not have the counter-rotation capability of two spaced wheels 49.

Figure 4:
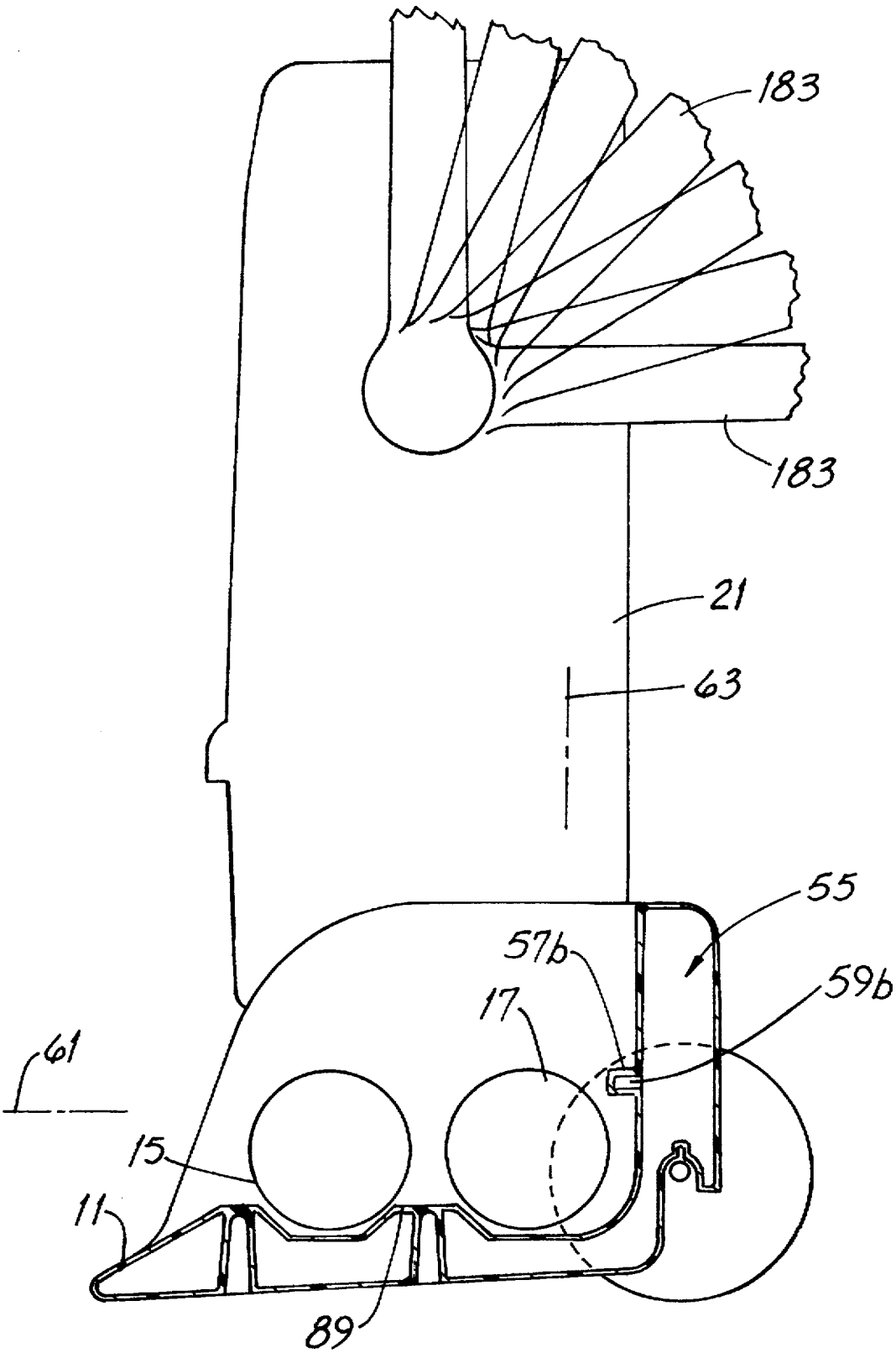
FIG. 4 is a side elevation view, partly in phantom, showing the machine mounted in the transport platform.

Referring particularly to FIGS. 4, 6 and 8, the arrangement includes a pair of machine restraint mechanisms 53 and 55, respectively, for releasably coupling the machine 10 and the platform 11 to one another. While specific details of each mechanism 53, 55 will be described in turn, the mechanisms 53, 55 share some common aspects.

Each restraint mechanism 53, 55 includes a machine-mounted restraining member 57*a*, 57*b* for engaging a platform-mounted restraining member 59*a*, 59*b*. Individually, the mechanisms 53, 55 substantially prevent movement of the machine 10 away from the base although as to each mechanism 53 or 55, such motion prevention is with respect to different reference points.

Referring particularly to FIG. 4, in a more specific embodiment, the platform-mounted restraining member 59*b* is a projection such as a horizontally-disposed, elongate tongue extending inwardly from the rear panel 45 of the platform 11. The machine-mounted restraining member 57*b* is a projection-receiving cavity such as a horizontally-disposed, elongate groove sized and shaped to receive the tongue with slight clearance. The projection and cavity separate and engage when the platform 11 and machine 10 are relatively-moved along a first axis 61. And the projection and cavity lock to one another when the platform 11 and machine 10 are relatively-urged along a second axis 63. In a highly preferred embodiment, the platform 11 and machine 10 are configured so that when the machine 10 is standing upright in the platform 11, the first axis 61 is horizontal and the second axis 63 is angular to the first axis 61 and, most specifically, is generally perpendicular to such first axis 61.

Referring particularly to FIGS. 6 and 8, in the restraining mechanism 53, the restraining member 59*a* includes a projection such as a pin mounted for reciprocal movement and the other restraining member 57*a* is a socket for receiving the pin. In the illustrated embodiment, the pin is on a lever 65 movable horizontally in a slot 67 for urging the pin into and out of engagement with the socket on the side of the machine 10.

From the foregoing, it is apparent that either one of the restraint mechanisms 53, 55 helps restrain the platform 11 and machine 10 from moving away from one another. However, the preferred arrangement uses both mechanisms 53, 55 for quick, secure platform-machine locking and unlocking.

Referring particularly to FIGS. 2 and 6, the platform 11 includes a notable convenience feature. The platform 11 has a structure 69 mounted with respect to the base 39 for carrying equipment ancillary to carpet cleaning. Such equipment may include hoses, hose extensions, nozzles, liquid and particulate carpet cleaning products—and even the machine-user's lunch.

The structure 69 includes a rigid support device 71 such as an exemplary inverted U-bar 71*a* extending upwardly away from the base 39 and, particularly, upwardly from a side panel 41 or 43. In a highly preferred arrangement, there is a second inverted U-bar 71*b* extending upwardly from a side panel 43 or 41.

A container 73 is mounted with respect to the support device 71 and has at least one pocket 75 (and preferably several pockets 75) for carrying equipment. While a rigid or flexible container 73 could be used, the container 73 of a highly preferred embodiment includes a flexible body panel 77 having surfaces 79, 81 which are exterior and interior, respectively, when the container 73 is mounted to the support device 71. The pocket 75 is on the exterior surface 79 and the container 73 includes a sleeve 83 on the interior surface 81 for slidably engaging the support device 71. The platform 11 is thereby configured so that the container 73 may be easily attached to and removed from the support device 71 by slipping the sleeves 83 over respective support devices 71. This arrangement helps "carry the closet" (of cleaning compounds, nozzles and the like) with the machine 10. (A preferred embodiment contemplates a pair of side-mounted containers 73, one container 73 "sleeved" over each device 71*a*, 71*b*. And, of course, a single container 73 on one device 71*a* or 71*b* or a wrap-around container 73 supported by both devices 71*a*, 71*b* may be used.)

In another aspect of the invention, the platform 11 is configured to prevent the cleaning members 15, 17 from becoming flattened or "taking a set" which might impair the cylindrical shape of such members 15, 17 and which may impair their performance in cleaning carpets 26. Referring to FIGS. 4, 6, 9 and 10, the platform base 39 includes a surface 85 and at least one chock 89 extending above the surface 85 for supporting a significant part or substantially all of the weight of the machine 10. The chock 89 extends above the base surface 85 by a dimension selected so that when the machine 10 is resting on the chocks 89 (there is a chock 89 adjacent to and extending inwardly from each side panel 41, 43), the distance D1 from the axis of rotation to the surface 85 is slightly greater than the distance D2 from the axis of rotation 91 to the outer perimeter of the member 15, 17.

Referring particularly to FIGS. 6 and 10, the chocks 89 are horizontally spaced from one another and each of the chocks 89 has a terminus 93. The machine carpet cleaning member 15, 17 has a length L and the spacing S between the terminii 93 is greater than the length L of the member 15, 17. So configured, the member 15, 17 fits between the chocks 89 and lateral surfaces of the machine 10 rest atop the chocks 89.

Another aspect of the invention involves a new method for transporting a carpet cleaning machine 10 having a carpet cleaning member 15, 17 (i.e., one or more lowered rollers, pads, brushes or the like) and a motor 35 for rotatably driving the member 17. The method contemplates a cleaning machine 10, the member 17 (or a member 15, 17) of which rotates in a direction to help propel the machine 10 onto the platform 11.

The method includes the steps of energizing the drive motor 35, tipping the machine 10 as shown in FIG. 2 to cause the member 17 to urge the machine 10 onto the platform 11 and coupling the machine 10 and the platform 11 to one another. Preferably, the method is practiced using a machine 10 having two carpet cleaning members 15, 17 counter-revolving in directions as shown in FIG. 5. In that way, the members 15, 17 may be used for powering the machine 10 off of the platform 11 as well as onto such platform 11 as described above.

When placing the machine 10 on the platform 11, the machine 10 is tipped to transfer machine weight onto the member closer to the platform 11, i.e., member 17 in FIG.

4, so that more than 50% of the machine weight is thereby on such member 17. The member 17 thereupon propels the machine 10 onto the platform with little or no effort by the user. To "drive" the machine 10 from the platform 11, the machine 10 is tipped to transfer machine weight onto that member 15 nearer the front opening 97.

In a more specific aspect of the method, the coupling step includes urging the machine 10 onto the platform 11 to a position engaging a first restraint mechanism 53 and, even more specifically, also engaging a second restraint mechanism 55. Where the platform 11 includes one or two chocks 89 for supporting machine weight, the tipping step is followed by the step of urging the machine 10 atop the chocks 89. The machine 10 may be urged atop the chocks 89 by the "driving" member 17 (while tipping the machine 10 as described above) or by lifting the machine 10 slightly with respect to the platform 11.

System for Removing Dirty Material from Machine Air Stream

Referring next to FIGS. 3, 5, 7, 8 and 12, the machine 10 has an air stream cleaning system 25 confined in the housing 21. Such system 25 includes a centrifugal separator 101 having an air entry port into which an air stream is tangentially introduced into the separator neck portion 103. The air stream 105 (made possible, of course, by the vacuum motor 23) originates at the vacuum nozzle 33 and has dirty material 107 entrained in it. Such material 107 is removed from the carpet 26 during cleaning.

The air stream 105 spirals downwardly along the cone-shaped portion and a portion of the dirty material 107 entrained in such air stream 105 (especially more dense material 107) is thrown outwardly by centrifugal force and falls through the cone end to a receptacle 111 below. The air stream 105 then flows upwardly toward the separator exit mouth 113 toward other filter media which may be included in the system 25 and toward the air exhaust port.

A first air flow guide 115 is fixed with respect to the mouth 113 and includes a first "flow-through" aperture 117 having a first area A1 as represented by the area circumscribed by the circle A1. A second air flow guide 119 is fixed with respect to the first guide 115 and includes a second flow-through aperture 121 having a second area A2 (circumscribed by the circle A2) which is less than the first area A1. Thus, air entraining dirty material 107 and leaving the separator 101 must pass through two apertures 117 and 121 having respective areas A1, A2 which are progressively smaller than the area AEM of the separator exit mouth 113, such area AEM being that area circumscribed by the circle AEM.

The two flow guides 115, 119 are preferably configured as a one-piece structure and define a slot-like cavity 123 between them. The air stream moves through the first guide 115 in a first direction as represented by the arrow 105, i.e., away from the cone-end 109 of the cyclone separator 101 and toward an exit opening. The cavity 123 converges in the same direction and captures dirty material 107 which is removed from a carpet 26 and passes through the first aperture 117. The cavity 123 thereby prevents such material 107 from entering and passing through the second aperture 121.

Other aspects of the invention involve positional relationships of parts. The separator 101 includes the above-noted cone-shaped portion 127 and the generally-cylindrical neck portion 103 above such portion 127 and terminated by the mouth 113. The first and second guides 115 and 119, respectively, include first and second guide portions 129 and 131, respectively, which extend into the neck portion 103.

The separator 101 and the guides 115, 119 are coincident with a central axis 133 and in a very specific embodiment, the separator 101 and apertures 117, 121 are circular and concentric with such axis 133. The guide portions 129, 131 "transition" inwardly toward the axis 133 and in a second direction, i.e., toward the cone-shaped portion 127 of the separator 101.

And while it is feasible to mount a mesh-type filter medium away from the guides 115, 119, in a highly preferred embodiment, there is a pocket 135 fixed with respect to the guides 115 and 119, most preferably, formed in the second guide 119. One or, preferably, two lift-out filters are conveniently placed in the pocket 135.

(It is apparent from the foregoing that the separator 101, filters 137 and any other filters subsequent to the filters 137 are arranged in what may be described as "air flow series." That is, air from the vacuum nozzle 33 flows first through the separator 101, then through the guides 115, 119 and filters 137 and then through any other filter and to the machine exhaust port.)

A new method for removing dirty material 107 from air flowing through a centrifugal separator 101 includes the steps of providing first and second flow guides 115, 119 fixed with respect to the separator 101 and having a cavity 123 between them. Air-entrained dirty material 107 flows into the separator 101 and a portion of the dirty material 107 is captured in the cavity 123. Such material 107 is later released to fall downwardly through the separator 101 to the slide-out collection receptacle 111 shown in FIG. 8. The flowing step includes energizing a vacuum motor 23 and the releasing step includes de-energizing such motor 23.

While the arrangement is considered to be operative for all types of dirty material 107, it is particularly effective with particulate material such as HOST® dry extraction carpet cleaning granules as made by Racine Industries, Inc. of Racine, Wis., in that such material tends to "pack" in the cavity 123. And of course, dirty material 107 caught in the cavity 123 does not go downstream to clog a mesh filter 137. "Between-cleaning" filter life is significantly extended. When the flow guides 115, 119 are made of a transparent material, the machine user may view the interior of the separator 101 (and whether or not it is clogged in some way) after removing the filter(s) 137 but without removing the guides 115, 119.

Maintenance-Reducing/Productivity-Improving Features

The new machine 10 has a number of features which improve productivity by lengthening the time during maintenance "intervals." Putting it another way, such features increase machine "up-time," i.e., the aggregate time over which the machine 10 is available for carpet cleaning. The above-described arrangement of the air stream cleaning system 25 is but one of such features.

Referring next to FIGS. 5, 7, 9 and 13–17, each revolving carpet cleaning member 15, 17 (brush, roller, pad or the like) is powered by a respective drive shaft 141 driven by a gear 143. Each such cleaning member 15, 17 has first and second ends 145 and 147, respectively. (For this description, only member 15 is shown.) considering a single cleaning member 15, the drive shaft 141 is coupled to the first end 145 and a non-powered or idler shaft 149 is supported by a bearing 151 and is coupled to the second end 147. Such idler shaft 149 is spaced from the drive shaft 141 and supports the second end 147 for rotation. Powered mounting of a cleaning member 15 in that way avoids tapering problems associated with cantilever mounting.

More specifically, the first end 145 includes a first bushing 153 having an opening 155 configured to a torque-transmitting shape such as a hexagon 157, square 159, oval 161, triangle 163 or the like. The drive shaft 141 is also configured to the torque-transmitting shape for driving engagement with the first bushing 153. (While a shaft 141 having a hexagon cross-sectional shape is shown and preferred, any random or regular geometric shape except a circle will transmit torque from the gear 143 to the member 15.)

Similarly, the second end 147 includes a second bushing 165 coacting with the idler shaft 149 for supporting the second end 147. Most preferably (at least for commonality of bushings 153, 165 and shaft stock), the second bushing 165 and the idler shaft 149 are also respectively configured to the torque-transmitting shape.

In the cleaning member 15, the carpet-contacting portion 169 is supported by a hollow interior tube 171 concentric with the axis of rotation 91 of the cleaning member 15. The drive shaft 141 is coupled to the first bushing 153 and drives the idler shaft 149 through the tube 171 and the second bushing 165.

From the foregoing, it is to be appreciated that the cleaning member 15 is supported at both ends rather than merely being supported "cantilever-fashion" at one end. And the member 15 is symmetrical so that a person replacing a member 15 may do so without taking time to ascertain which end 145, 147 goes on which shaft 141, 149.

Figure 7:
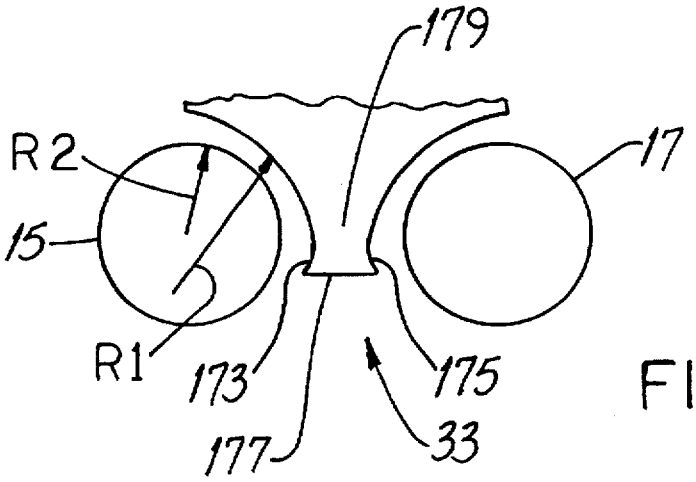
FIG. 7 is a representative side elevation view showing features of the machine vacuum nozzle. Parts are broken away.
Figure 11:
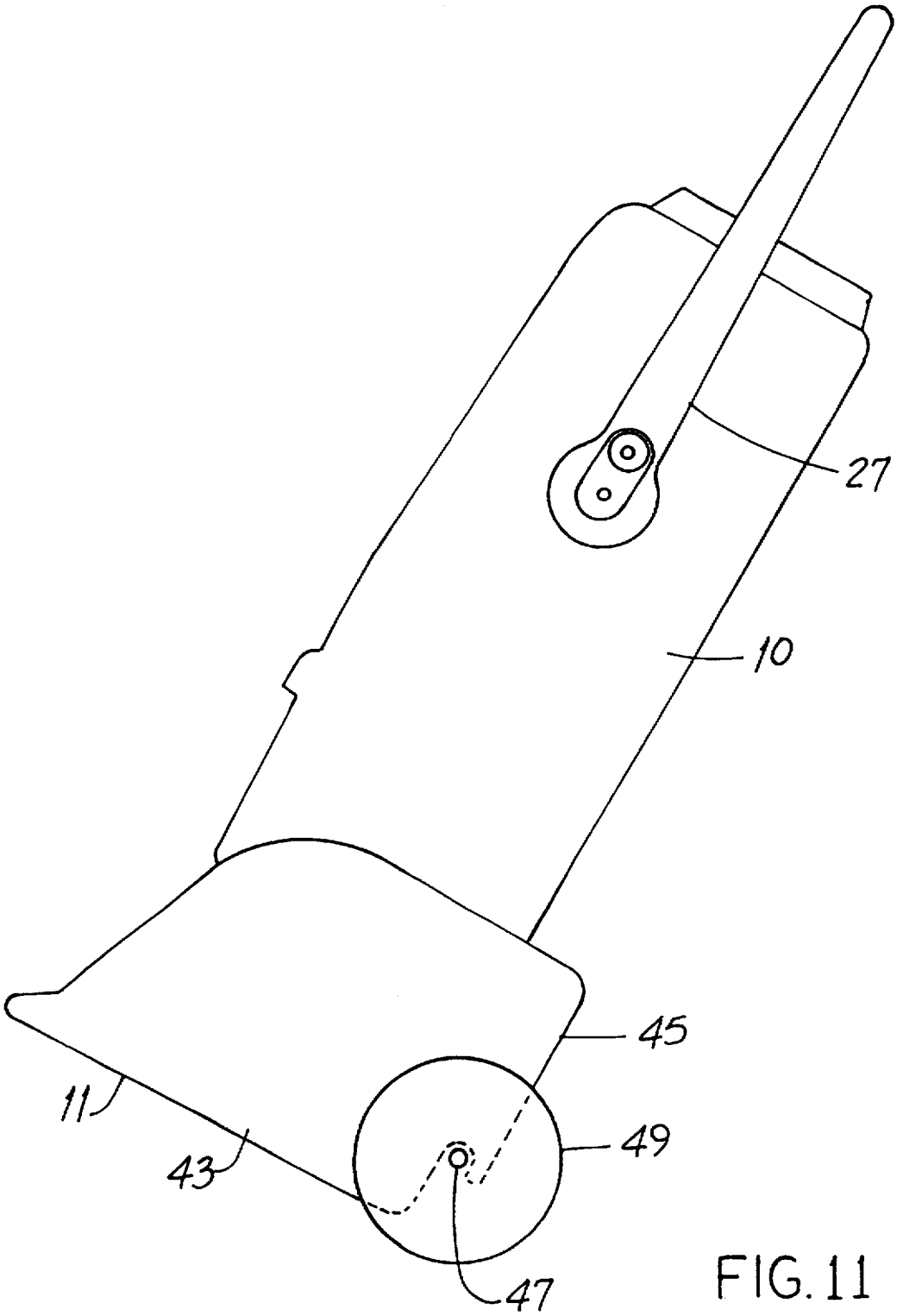
FIG. 11 is a representative side elevation view showing the machine and its transport platform in a machine-transporting configuration and orientation.
Figure 18:
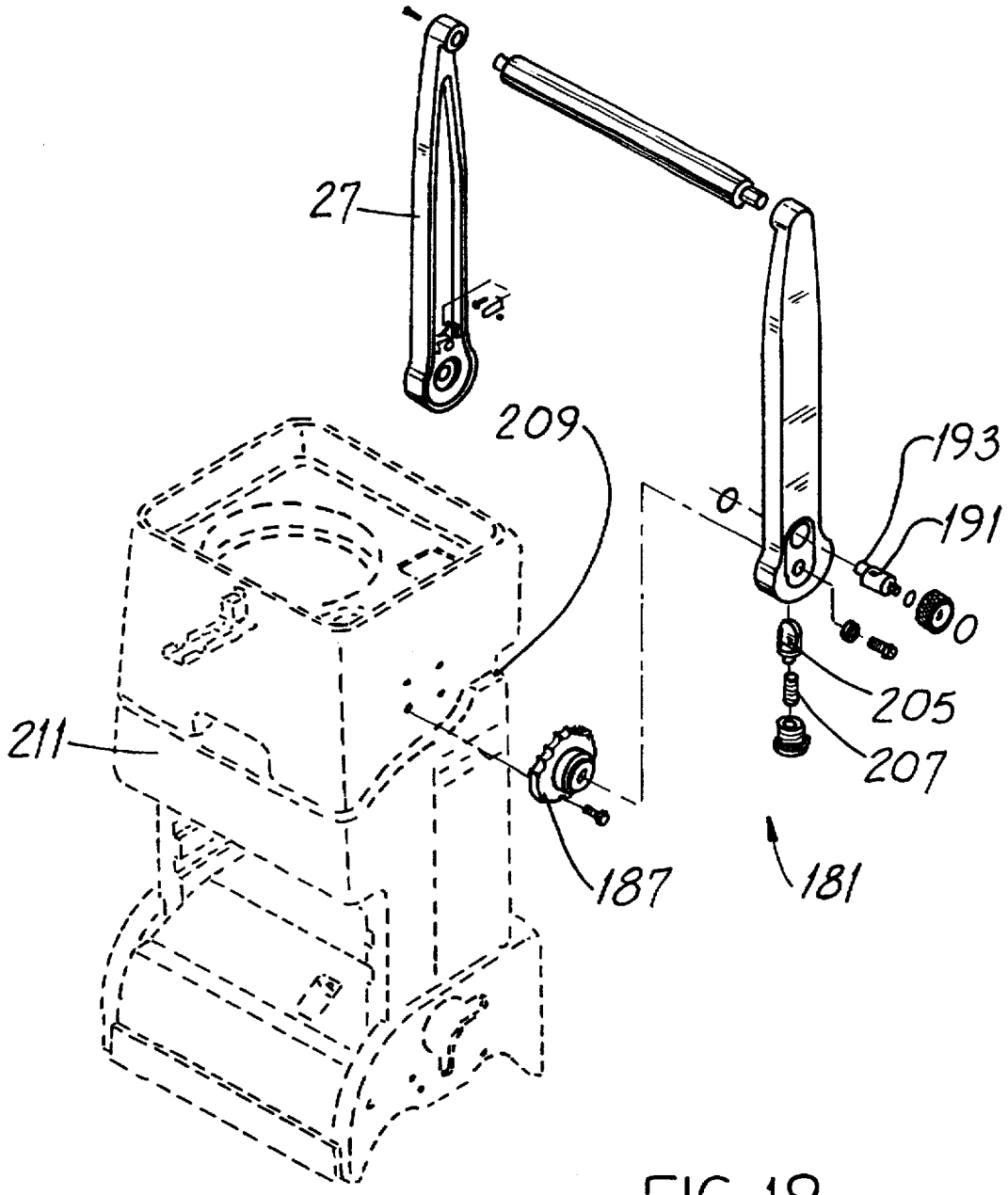
FIG. 18 is an exploded view, partially in phantom, showing the machine handle and handle stop mechanism.

Another maintenance-reducing feature is provided in recognition of the propensity of certain types of dirty material to bridge or span across a less-than-optimally configured vacuum nozzle. Referring next to FIGS. 3 and 7, a vacuum nozzle 33 is between the cleaning members 15, 17 and directs the dirty material 107 drawn away from the carpet 26 to the separator 101. In end view (viewed along the axes of rotation 91 of the cleaning members 15, 17), the nozzle 33 is somewhat wedge-shaped and includes a first surface 173 toward the first cleaning member 15 and a second surface 175 toward the second cleaning member 17.

Preferably, the surfaces 173, 175 are curved, i.e., they have a radius of curvature or radii of curvature. Most preferably, the radius of curvature R1 of the first surface 173 is greater than the radius of curvature R2 of the first member 15 so that when viewed from nozzle top to nozzle bottom, most points on a surface 173 of the nozzle 33 becomes progressively farther spaced from its respective cleaning member 15. The nozzle 33 terminates in a flared mouth 177 substantially preventing nozzle clogging.

Immediately above the flared nozzle 33 is a region 179 of reduced cross-sectional area, i.e., a region 179 having an area somewhat less than that of the flared mouth 177. Such region 179 slightly increases the velocity of air flowing therethrough and helps clear dirty material 107 through the nozzle 33.

And that is not all. Referring also to FIGS. 1, 2, 4, 11 and 18–21, the machine has a handle 27 cooperating with a handle stop mechanism 181 for retaining the handle 27 at any one of several selected positions. The arched handle 27 is coupled to the housing 21 at first and second pivot mounts 29 and 31, respectively, and an adjustable stop mechanism 181 is at the second pivot mount 31 for retaining the handle 27 at any one of several available angular positions as represented by the position "markers" 183 in FIG. 4.

Figure 19:
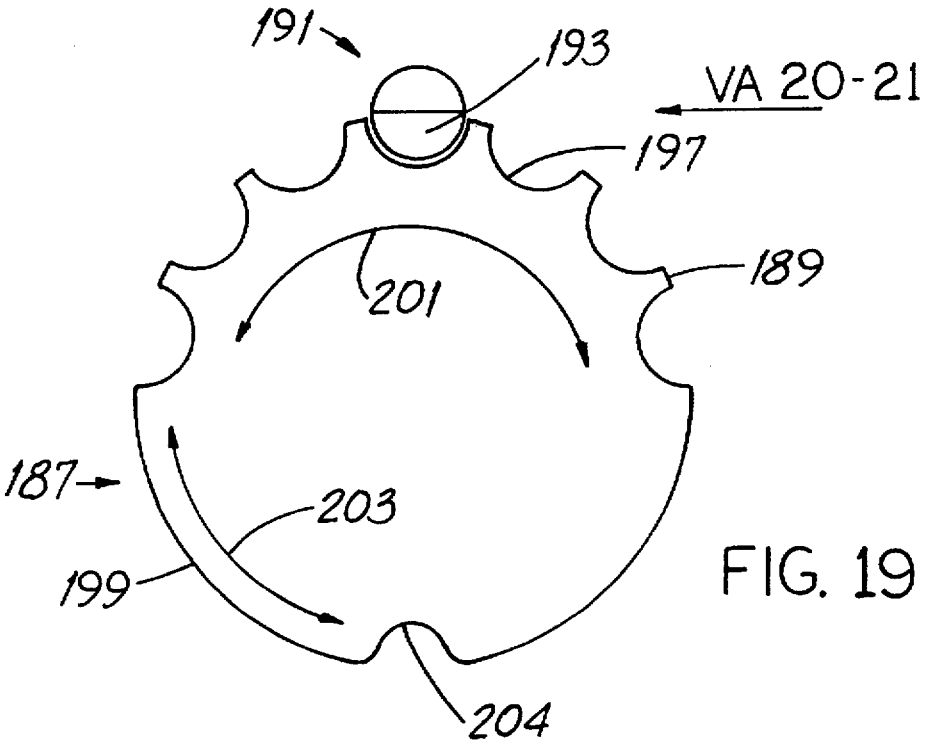
FIG. 19 is an elevation view of components of the handle stop mechanism.
Figure 20:
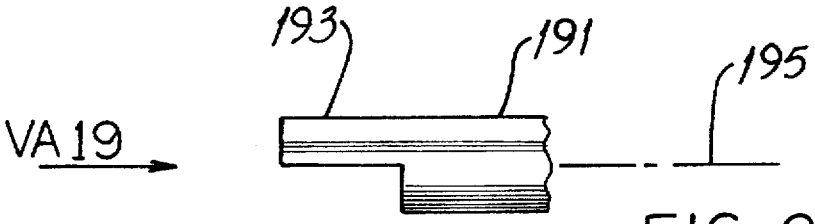
FIG. 20 is a side elevation view of the handle stop member taken along the viewing axis VA20-21 of FIG. 19. Part is broken away.
Figure 21:
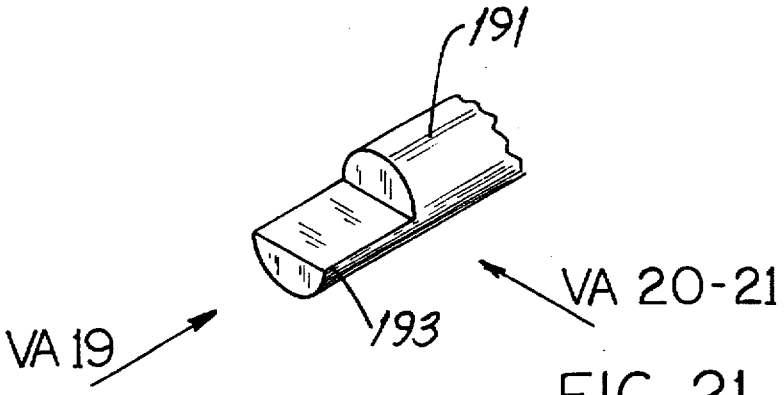
FIG. 21 is a perspective view of the handle stop member of FIGS. 19 and 20. Part is broken away. The stop member generally appears as in FIG. 19 when viewed along the viewing axis VA19 of FIGS. 20 and 21.

The stop mechanism 181 includes a "starwheel-like" plate 187 fixed with respect to the housing 21 and having a plurality of radially-outwardly-directed projections 189. A stop member 191 is mounted for rotation between a first position and a second position and includes a pin 193 eccentric to the stop member center axis 195. The stop member 191 is mounted on the swinging handle 27 and engages a projection 189 when the pin 193 is rotated to the first position as represented by FIGS. 19 and 21. In other words, when the pin 193 is in registry with one of the notches 197 in the plate 187, the handle 27 is locked in a position. And the handle 27 is free to swing when the stop member 191 is rotated so that the pin 193 is spaced from the projections 189 when the pin 193 is at the second position as represented by FIG. 20.

While the stop mechanism 181 permits the handle 27 to be locked at any of several positions, the mechanism 181 is constructed in such a way that the handle 27 cannot be locked in all of its available positions. The mechanism plate 187 is generally circular and has an edge 199 and the projections 189 extend over a first arc 201 along the edge 199. A second arc 203 along the edge 199 is free of projections 189 so that the stop pin 193 is unable to lock the handle 27 in positions where the pin 193 is in registry with the second arc 203. A user is thereby prevented from damaging the machine 10 and/or the handle 27 or mechanism 181 by trying to lift or move the machine 10 while the handle 27 is in one of such positions.

Considering FIGS. 18–21, the handle 27 is locked in position when the stop member 191 is rotated to the position shown in FIGS. 19 and 21. And the handle 27 is free to swing when the stop member 191 is rotated to the position shown in FIG. 20.

And there are other convenience features. The stop mechanism 181 includes a groove 204 and a detent finger 205 which is lightly spring biased toward the groove 204. When the handle 27 is vertical, the finger 205 engages the groove 204 and retains the handle 27 upright. However, the groove 204, finger 205 and spring 207 are selected and configured so that light hand force on the handle 27 will urge such handle 27 out of detent.

The housing 21 also has a stop face 209 formed therein so that when the handle 27 pivoted toward such face 209, the face 209 supports the handle 27 in a substantially horizontal position. And the housing 21 and stop mechanism 181 are configured so that the handle may be pivoted the other direction, i.e., toward the face 211 of the housing 21 and contact such face 211.

While the principles of the invention have been shown and described in connection with a few preferred embodiments, it is to be understood clearly that such embodiments are by way of example and are not limiting.

What is claimed:

1. In a carpet cleaning machine including (a) a centrifugal separator with an air stream exit mouth having a mouth area, and (b) a vacuum motor for drawing air through the separator, the improvement comprising:

a first air flow guide spaced inwardly from the mouth and including a first aperture having a first area less than the mouth area; and a second air flow guide fixed with respect to the first guide and including a second aperture having a second area less than the first area;

and wherein:

the flow guides include a cavity therebetween for capturing dirty material removed from a carpet and entering the first aperture, thereby causing the dirty material to fall along a path spaced from the exit mouth when the vacuum motor is turned off.

2. The machine of claim 1 wherein:

the separator includes a neck portion terminated by the mouth; and the first guide includes a first guide portion extending into the neck portion.

3. The machine of claim 2 wherein the second guide includes a second guide portion extending into the neck portion.

4. The machine of claim 2 wherein the guides are made of transparent material.

5. The machine of claim 1 wherein:

the separator and the guides are coincident with an axis;

air flows through the separator and the guides in a first direction; and the first guide includes a first transition portion tapered inwardly toward the axis in a second direction.

6. The machine of claim 5 wherein the second guide includes a second transition portion tapered inwardly toward the axis in a second direction.

7. The machine of claim 5 wherein the guides are made of transparent material.

8. The machine of claim 1 wherein:

the separator and the guides are coincident with an axis;

the machine includes a pocket coincident with the axis; and a filter is in the pocket.

9. In a carpet cleaning machine, a method for removing dirty material from air flowing through a centrifugal separator toward a filter in downstream series with the separator, and wherein the separator terminates in an upper neck portion, the method including the steps of:

providing first and second flow guides spaced inwardly from the neck portion and having a cavity therebetween;

flowing air-entrained dirty material into the separator;

capturing a portion of the dirty material in the cavity; and releasing the dirty material in the cavity to fall along a path spaced inwardly from the neck portion.

10. In a carpet cleaning machine including a centrifugal separator with an air stream exit mouth having a mouth area, the improvement comprising:

a first air flow guide fixed with respect to the mouth and including a first aperture having a first area;

a second air flow guide fixed with respect to the first guide and including a second aperture having a second area less than the first area;

a cavity between the first and second guides for capturing dirty material removed from a carpet and entering the first aperture;

and wherein:

the separator includes a neck portion terminated by the mouth; and the first guide includes a first guide portion extending into the neck portion.

11. The machine of claim 10 wherein the second guide includes a second guide portion extending into the neck portion.

12. The machine of claim 10 wherein the guides are made of transparent material.

13. In a carpet cleaning machine including a centrifugal separator with an air stream exit mouth having a mouth area, the improvement comprising:

a first air flow guide fixed with respect to the mouth and including a first aperture having a first area;

a second air flow guide fixed with respect to the first guide and including a second aperture having a second area less than the first area;

and wherein:

the separator and the guides are coincident with an axis;

air flows through the separator and the guides in a first direction; and the first guide includes a first transition portion tapered inwardly toward the axis in a second direction.

14. The machine of claim 13 wherein the second guide includes a second transition portion tapered inwardly toward the axis in a second direction.

15. The machine of claim 13 wherein at least one of the guides is made of transparent material.

16. In a carpet cleaning machine including a centrifugal separator with an air stream exit mouth having a mouth area, the improvement comprising:

a first air flow guide fixed with respect to the mouth and including a first aperture having a first area;

a second air flow guide fixed with respect to the first guide and including a second aperture having a second area less than the first area;

a cavity between the first and second guides for capturing dirty material removed from a carpet and entering the first aperture;

and wherein:

the separator includes a neck portion terminated by the mouth; and the first guide includes a first guide portion extending into the neck portion;

and wherein the machine further includes (a) counter-revolving first and second carpet cleaning members for removing dirty material from a carpet, and (b) a vacuum nozzle between the cleaning members for directing the dirty material to the separator, and wherein:

the nozzle includes a first surface toward the first member;

the first member has a radius of curvature;

the first surface has a radius of curvature; and the radius of curvature of the first surface is greater than the radius of curvature of the first member.

17. In a carpet cleaning machine including a centrifugal separator with an air stream exit mouth having a mouth area, the improvement comprising:

a first air flow guide fixed with respect to the mouth and including a first aperture having a first area;

a second air flow guide fixed with respect to the first guide and including a second aperture having a second area less than the first area;

and wherein:

the separator and the guides are coincident with an axis;

air flows through the separator and the guides in a first direction; and the first guide includes a first transition portion tapered inwardly toward the axis in a second direction;

and wherein the machine further includes (a) counter-revolving first and second carpet cleaning members for removing dirty material from a carpet, and (b) a vacuum nozzle between the cleaning members for directing the dirty material to the separator, and wherein:

the nozzle includes a first surface toward the first member;

the first member has a radius of curvature;

the first surface has a radius of curvature; and the radius of curvature of the first surface is greater than the radius of curvature of the first member.

* * * * *